United States Patent [19]

Johnson, Jr.

[11] 4,075,942

[45] Feb. 28, 1978

[54] METHOD AND APPARATUS FOR FEEDING A BALE PRESS

[75] Inventor: Joe Johnson, Jr., Powder Springs, Ga.

[73] Assignee: Coats & Clark, Inc., Stamford, Conn.

[21] Appl. No.: 749,815

[22] Filed: Dec. 13, 1976

[51] Int. Cl.[2] ..... B30B 7/04

[52] U.S. Cl. ..... 100/42; 19/308; 100/45; 100/91; 100/137; 100/173; 100/215

[58] Field of Search ..... 100/35, 42, 45, 49, 100/137, 138, 256, 255, 176, 91, 173, 215; 19/107, 155, 204, 205, 156.4

[56] References Cited

U.S. PATENT DOCUMENTS

| | | | |
|---|---|---|---|
| 1,788,620 | 1/1931 | Elliott | 100/137 |
| 1,931,488 | 10/1933 | Deems | 100/215 |
| 2,747,235 | 5/1956 | Wallace | 19/203 |
| 2,955,529 | 10/1960 | Marble | 100/215 |
| 3,024,721 | 3/1962 | Brooks | 100/137 |
| 3,239,889 | 3/1966 | Caughlin | 19/156.4 |

*Primary Examiner*—Billy J. Wilhite

*Attorney, Agent, or Firm*—Burgess, Ryan and Wayne

[57] ABSTRACT

In a bale press feeder, waste material is drawn into a condenser to form a fluffy blanket. The thickness of the blanket is decreased by passing the blanket through rolling devices with successively reduced clearance, and then by drawing the blanket through a chamber of successively reduced height by a conveyor belt. The thereby compressed blanket is fed to a bale press. A packer, operated in response to the feeding of the compressed blanket to the bale press, cyclically packs the blanket in the press.

17 Claims, 10 Drawing Figures

FILTER
DRIVE MOTOR

METHOD AND APPARATUS FOR FEEDING A BALE PRESS

BACKGROUND OF THE INVENTION

This invention relates to a method and apparatus for feeding a bale press. The invention is of particular importance, and hence is particularly directed to the packing of a bale press with waste material, such as waste fibers, in order to form bales of such material with the introduction of a minimum amount of dust to the atmosphere.

In mills wherein fibrous materials are handled, such as, for example, mills for producing cotton yarn and threads, the different processing equipment, such as combers, drawers, lappers, opening machines, pinking machines, and rollermatic machines, produce a certain amount of waste material. Some of the waste material may be recycled, and some of the waste material may be employed for other products, depending, for example, upon the staple length, dust content, etc. In any event, however, the disposal of the material will generally require packaging to a useable form, for example, bales.

The waste material may be expeditiously transported within a mill by means of permanently installed vacuum apparatus, so that the waste from the different machines or areas is automatically or semiautomatically directed to a central collection area. In this collection area the waste fibers may be directed into bins or trucks, with the waste material in each such container being identified preferably with respect to its origin, so that a proper disposition may be made of bales formed of such material.

In the past, it has hence been conventional to direct the material, for example, by manual feeding, from the bins or trucks to a bale press. Cotton fibers of the above type tend to be quite dusty, and the handling of the cotton fibers in this manner with the consequent agitation of the fibers, resulted in the release of large quantities of dust to the atmosphere. The working conditions in such manual loading facilities were therefore generally undesirable. Tests of the atmosphere in facilities of this type have shown in excess of 20 mg. per cubic meter of dust having particle sizes between 5 and 15 microns. The size of the dust particles is given in this example, since dust particles within this range of sizes are considered to be the most dangerous and to constitute a health hazard.

In addition to the health hazard resulting from the release of dust to the atmosphere, the manual loading of the bale presses also created a safety hazard, since it was necessary for the personnel in the facility to directly feed an partially pack the loose cotton fibers into the bale press.

Recently, standards have been established for the quality of air in mills of this type. More specifically, the Office of Safety and Health Administration has established a standard, whereby personnel without breathing apparatus such as filters may not work full time in facilities having more than 1 mg. of dust per cubic meter, of a size in the range of 5 to 15 microns. In view of the large quantities of dust which are present in cotton fiber waste materials, this standard has been especially difficult to meet, and, at least up until the time of the present invention, it is believed that no practical solution has been found for the problem.

As an example, in studies leading to the present invention material handling fan devices were employed to pick up the cotton waste from the trucks, and direct it to the press. This solution was unsatisfactory, since it did not result in an adequate reduction of dust in the atmosphere, and produced the additional undesirable results that an excess amount of air was directed into the bale press. In a further attempt to solve the problem, the manual feeding of the press was eliminated by directing the waste fibers from the storage bins or trucks to the bale press by gravity, with screens being provided to avoid build-up of air. This solution was also unsatisfactory, since the dangerous dust being of a small particle size, readily passed into the atmosphere of the facility.

In still further attempts to solve the problem, the cotton waste was directed to sets of dust bags, but this solution also resulted in the generation of too much dust in the facility. Still further, a condenser, of the type employed in the mill, was modified to collect the waste fibers from the storage bins, with the cotton fiber from the condenser being discharged to the bale press. This solution was also unsatisfactory, since the output of a condenser is fluffy, and as a consequence an adequate amount of cotton fiber could not be fed to the press before raising of the ram of the press, so that excessive operation of the bale press ram was necessary.

It is therefore apparent that it is difficult to adequately reduce the dust content of the atmosphere in a bale press feeding facility for packing fibrous materials, such that the dust content of the air in the packing facility be reduced below the 1 mg. per cubic meter standard.

The present invention is consequently directed to a method and apparatus for solving this problem.

Briefly stated, in accordance with the invention, a condenser of the above discussed type is employed to form a blanket from the waste material. In one arrangement in accordance with the invention, an operator may be employed to manipulate the input pipe of the condenser in a bin or storage truck, although automatic equipment may be alternatively employed for this purpose.

The inner output of the condenser may be directed to a conventional filter, for removal of dust. The filter may of course advantageously be positioned externally of the mill, so that the dust which may be released by the condenser is not recirculated in the mill.

As discussed above, the fiber blanket output of a conventional condenser is fluffy, and cannot be employed to properly feed a bale press. Consequently, in accordance with the invention, the blanket is passed through rolling devices of successively decreasing clearance, whereby the thickness of the blanket is reduced and its density is consequently increased. In addition, in accordance with the invention, the precompressed blanket may be further compressed by conveying it on a conveying belt to the bale press through a chamber of gradually reduced height. The chamber thus serves the function of confining all dust particles, while enabling still further compression of the blanket. It is of course to be understood that the remainder of the processing equipment of the invention is also sealed in a dust-tight manner, to avoid release of dust particles in the range of 4 to 15 microns.

The bale press has a loading door which is angularly disposed at the outlet of the conveyor belt, so that the compressed blanket is fed directly into the bale press. In accordance with the invention, the blanket thus fed to the bale press is packed by means of a hydraulically operated foot extending downwardly through the bale press loading door opening, the packer preferably being operated cyclically in response to the presence of waste fibers to be packed. Specifically, the chamber is provided with a hinged portion at its outlet, so that a switch cooperatively positioned with respect to the hinged portion is actuated by the passage of water fiber thereunder. Operation of the switch, which is therefore responsive to the presence of waste materials to be loaded, may therefore be employed to initiate the cyclic operation of the packer through a determined number of cycles.

When the bale press is fully loaded, it may then be operated either manually or automatically to form the desired bales of material for shipping or other disposal, in a conventional manner.

The method and apparatus in accordance with the invention thereby enables either the complete or substantially complete automatic handling of the waste material, so that manual handling operations are no longer necessary. If an operator is employed, the operator need only direct the inlet suction pipe to the condenser. The method and apparatus in accordance with the invention have been found to thereby substantially reduce the amount of dust in the bale press facility, so that the standard of 1 mg. per cubic meter can be met.

In order that the invention will be more clearly understood, it will now be disclosed in greater detail with reference to the accompanying drawings, wherein.

Figures 1, 5, 6:
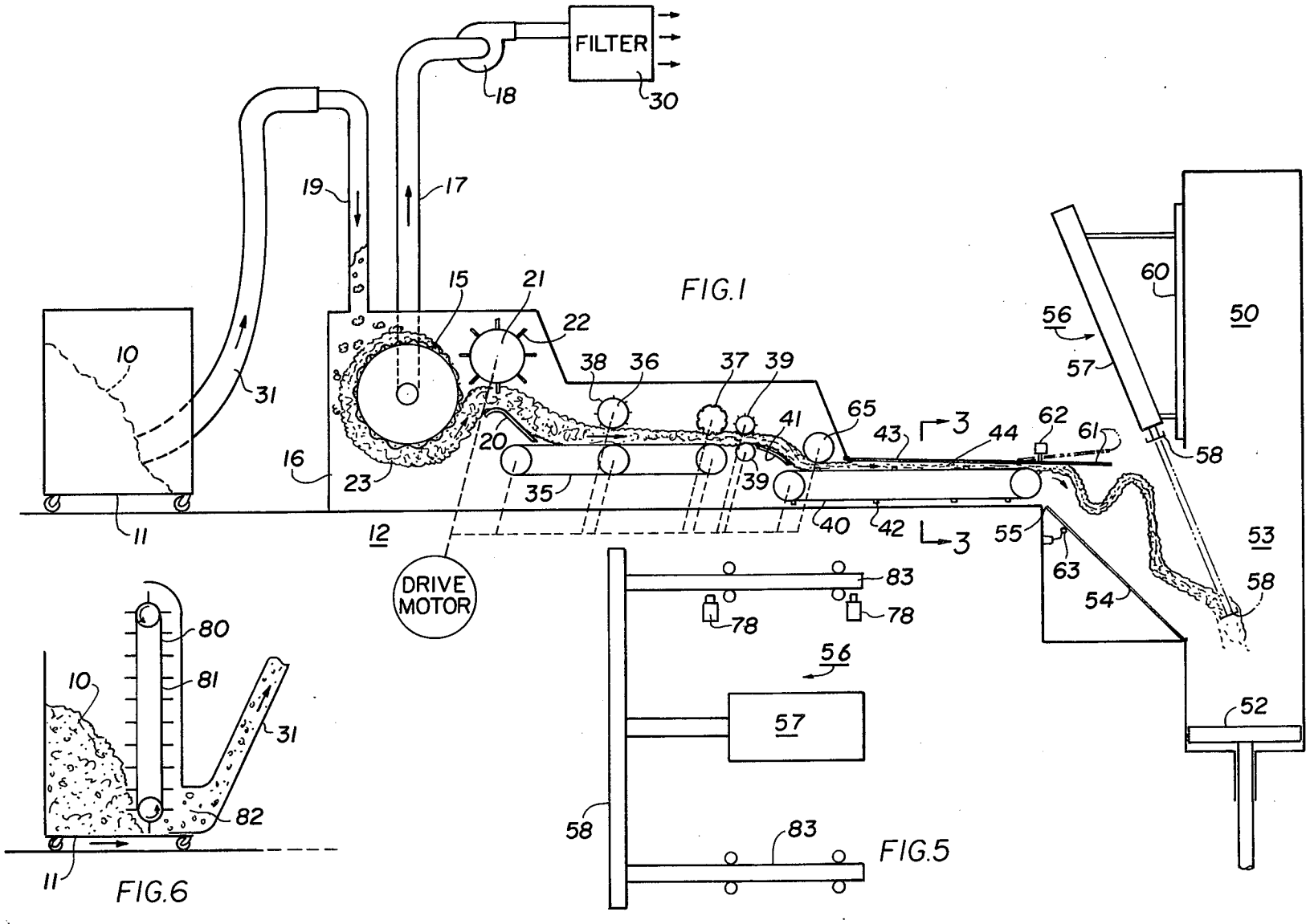
FIG. 1 is a simplified illustration of a bale press feeder in accordance with the invention.
FIG. 5 is a simplified illustration of the control system of the invention.
FIG. 6 is a simplified illustration of a modification of a portion of the arrangement of FIG. 1, showing an automatic feeder for the condenser thereof.

Referring now to the drawings, and more in particular to FIG. 1, loose fibrous material 10, such as cotton fibers from a mill, may be collected in a bin or truck 11, for disposal. As discussed above, these fibers may be derived from the various operating machines of a thread or yarn making mill, and may be collected by a conventional vacuum system. It will of course be apparent that the invention is not limited to the baling of cotton fibers, nor to thread and yarn making mills, and may be employed wherever the problem exists of baling fibrous materials while maintaining a minimum dust level in the baling facility.

The initial operating mechanism of the feeder in accordance with the invention is a condenser identified generally by the numeral 12. The condenser 12 may be basically a conventional Soco Lowell condenser, such as a number 11 and number 12 Soco Lowell Cotton Condenser, modified as will be specifically noted in the following paragraphs.

The condenser is generally comprised of a rotatable perforated drum 15 within a chamber 16. A suction pipe 17 is directed to suck air from the interior of the drum 15, for example, by means of a fan 18. The suction inlet to the condenser therefore comprises an inlet duct 19 directed generally to the housing 16. A chute 20 is disposed adjacent the drum, and a driven doffing roll 21, for example having a plurality of plastic vanes 22, is positioned to direct material from the surface of the drum onto the chute 20.

In operation of the condenser, it is apparent that material directed into the inlet duct 19 is sucked against the outer periphery of the drum 15 due to the vacuum pressure caused by the fan 18. This results in the build-up of a fluffy blanket 23 of the fibrous material on the surface of the drum, and upon rotation of the drum 15 and the doffing roll 21, the blanket 23 will be continually removed from the drum and directed downwardly on the chute 20. This portion of the equipment is conventional, and it will be understood that the housing 16 is constructed to be sufficiently air tight that substantially no particles in the size of 4 to 15 microns will be released to the atmosphere. In addition, a filter 30 is provided at the outlet of the fan 18, the filter 30 preferably being arranged to collect substantially all of the dust particles in the air, especially within the size range of 4 to 15 microns. The filter 30 is also preferably located outside of the mill itself.

In accordance with one embodiment of the invention, the duct 19 is connected to a flexible intake hose 31, which can be manually manipulated to empty the fibrous material from the storage truck 11. With this operation, the storage truck 11 which may contain about 120lbs. of loose cotton, may be emptied in a matter of, for example, 15 to 30 seconds, without the necessity for the operating personnel to contact or otherwise disturb the fibers. The dust that enters the atmosphere at this point in the operation is consequently minimized, with the majority of the dust being directed into the condenser.

In the condenser, the layer of loose cotton and fibrous material that builds up on the surface of the drum 15 is doffed by the roll 21 in the conventional manner, so that the fluffy blanket 23 is directed onto the chute 20, and thence onto an endless belt 35. A roll 36 is provided above the belt 35, and a further roll 37 is provided above and spaced from the belt 35, downstream of the roll 36. It will be appreciated that the general configuration of a belt at the output of a chute is known in a condenser apparatus, as is the provision of one or more rolls above the belt. In accordance with the invention, however, the clearance between the belt 35 and the roll 37 is substantially less than the clearance between the belt 35 and the roll 36. Consequently, the roll 37 serves as a first compression step for the fluffy blanket.

The belt 35 is preferably a slat picker apron type belt, to provide adequate backing for compressing the blanket. It will of course be apparent, that other belts may be employed for this purpose, as long as the concept of compressing the blanket is maintained.

In one embodiment of the invention, the roll 36 had short, hard plastic fins 38 extending axially along its surface, in order to aid in the movement of the fluffy blanket. The roll 37, however, had axially extending grooves in its surface. These features, while not essential to the concept of the invention, aided in maintaining the proper and continuous movement of the blanket in the compressing operation.

Immediately downstream of the belt 35, the precompressed blanket is fed between a pair of rollers 39. The rollers 39 are spring loaded by a spring 85, so that they are urged in contact with one another, with the nip of these rollers preferably being at a level centered with respect to the nip between the roller 37 and the belt 35. The rollers 39 thence direct the blanket onto a further conveyor 40, for example, a belt conveyor. For this purpose, a chute 41 may be provided extending from the outlet side of the rollers 39 to deposit the blanket onto the upper course of the belt 40. This particular arrangement was employed, in order to facilitate the feeding of the bale press, while still conveniently mounting the condenser at a floor level, whereby operation of the bale press, such as opening the bale press stores, was permissible as a result of the lower position of the belt 40. It will of course be apparent that the relative heights of the belts, etc., is thereby optional, and dependent upon the requirements of the components of major size and weight of the system, and may accordingly be varied as necessary.

The belt 40 may be a canvas belt of a conventional nature, and is preferably provided with transverse ribs 42, for example, of rubber, to aid in the transport of the blanket. The belt 40 serves primarily to transport the blanket to the bale press, although it also serves in an additional compressing function of the belt. Thus, as illustrated in FIG. 1, a fixed cover 43, for example a one-fourth inch thick aluminum plate, is positioned over the upper course of the belt 40, with the distance between the plate 43 and the belt decreasing in the balancing direction of the upper course of the belt 40. As a consequence, the belt 40 and plate 43 define a chamber 44 of decreasing cross section, through which the blanket is drawn by the belt 40. The reduction of cross section of the chamber 44 of course results in further compression of the blanket. While the canvas belt 40 may be backed in this compression stage, it has been found that a slight amount of sag in the belt, due to the use of a centrally unsupported belt, does not seriously interfere with the proper functioning of this stage of the system.

In the simplified illustration of FIG. 1, a bale press 50 of conventional design has a ram 52 mounted to define the bottom of the pressing chamber. The ram 52 is controlled from beneath the bale press by conventional means (not shown), such as a hydraulic system, to be movable vertically in the chamber 53 of the press. The press is provided with a loading door 54 hinged at its lower edge, so that the door 54 may be swung open to an inclined position, as illustrated in FIG. 1, with the top 55 of the door 54 at the outlet end of the belt 40. As a consequence, the compressed cotton blanket at the downstream end of the belt 40 will be directed generally downwardly and into the chamber 53 of the press, by the inclined door 54.

Further, in accordance with the invention, a packer is provided for packing the blanket into the press. The packer 56 may be comprised of a hydraulic cylinder system 57 fixedly mounted to the press 50 above the door 54, the hydraulic system 57 having a foot 58 extending transversely across the loading opening created by the door 54. As illustrated, the packing system is inclined, so that the packer foot 58 may be hydraulically actuated to extend downwardly into the chamber 53 of the press, and hence to prepack the cotton material in to the press. The rest position of the foot 58 of the packer is of course sufficiently high that it will clear the door 54 closed in the pressing operation in the bale press.

The bale press illustrated in FIG. 1 is provided with a further door 60 in the upper region thereof, and the door 60 may, if necessary, open on vertical hinges at one side to permit unloading of a finished bale from the press. In the illustrated embodiment of the invention, when this type of press is employed, the packer 56 may be mounted on the door 60 of the press, as a matter of convenience and so that the packer assembly will be moved out of the way, in an expeditious manner, when the door 60 is opened to remove a finished bale. As discussed above, it was due to this configuration of a bale press that the conveying system for the blanket was lowered, as compared with the level of the flat conveyor 35, to provide clearance for the bale press unloading door. It will of course be appreciated that, in accordance with conventional practice, suitable catching devices (not shown) may be provided in the upper regions of chamber 53 of the bale press, in order to restrain partially formed bales therein, so that a finished bale may be formed as a result of several loading operations of the blanket by way of the loading door 54.

In order to enable the automatic operation of the packer 56, a sensing system is provided at the downstream end of the chamber 54 at the last compression stage of the system. For this purpose, a plate 61 may be hinged to the downstream end of the plate 43, to extend over the door 54 when the door 54 is opened. As a consequence, when a blanket of compressed cotton fibers is directed from the downstream end of the chamber 44, it will exert an upward force on the plate 61, thereby pivoting the plate 61 slightly upwardly, as indicated by the chain dot lines in FIG. 1. A micro switch 62 is fixedly mounted to detect such pivoting of the plate 61. Operation of the switch 62 in response to such pivoting of the plate 61 may thus be employed, as will be discussed in greater detail in the following paragraphs, to effect the automatic control of the packer.

It will further be noted that a micro switch 63 is fixedly mounted to be actuated in the open inclined position of the door 54, when the bale press is in a condition to receive material to be baled. The switch 63 may be connected to remove driving power from the condenser and compression systems in accordance with the invention, whenever the door 54 is closed or being closed, during the steps of forming a bale in the press.

In one successful embodiment of the invention, a Soco Lowell condenser was employed, in combination with rolls 36 and 37 having 6 inch outer diameters. The roll 36 was spaced four inches from the belt 35, and the roll 37 was spaced two inches from the belt 35. In this arrangement, the rolls 39 had outer diameters of 2½ inches. In order to provide a suitable compressed blanket for baling of cotton fibers from a thread and yarn making mill, the slack belt 35 had a surface speed of 1256 inches per minute, while the roll 36 had a peripheral speed of 4712 inches per minute and the roll 37 had a peripheral speed of 3016 inches per minute. The rolls 39 had peripheral speeds of about 1256 inches per minute, as they withdrew the blanket from the slat belt 35. It has been found that this general relationship provides satisfactory compressed blankets, i.e., with the first roller 36 being driven at a speed in excess of the second roller 37, and both of these rollers having speeds greater than the speed of the slat belt 35.

In the above examples, the belt conveyor 40 was driven at a surface speed of 1193 inches per minute. It will be noted that this speed is somewhat less than the speed of the rollers 39, and hence a tendency was found for the compressed blanket to back up at the chute 41. As a consequence, a further roller 65 was provided at the upstream end of the conveyer belt 40, just preceding the plate 43, to ensure that this back up did not occur. The roll 65, in the above example of the invention, had a smooth surface, with a 5 inch outer diameter, and was driven with a surface speed of 2513 inches per minute, whereby backing up of the blanket no longer resulted at this point. It will be noted that each of the conveyers 35 and 40, as well as each of the rolls 36, 37, 39 and 55 are driven by conventional means (not shown in FIG. 1), such as gear, chain or belt drives of conventional nature.

In the above example in accordance with the invention, the plate 43 was spaced from the belt 40 two and one-half inches at its upstream end and 1½ inches at its downstream end, the plate 40 having a length of about 6 feet. In this arrangement, the rolls and belts were about 4 feet wide, and the plate 61 for detecting the presence of fiber to be packed, had a length, from the hinges thereof, of about 4 inches.

In the preferred embodiment of the invention, the condenser and precompressing assembly are completely confined, with the exception of the outlet end thereof feeding into the bale press. Thus, as illustrated generally in FIG. 2, an outer casing 70 is provided surrounding these elements, to ensure that 4–15 micron dust does not escape into the working space.

Figures 2, 3, 4:
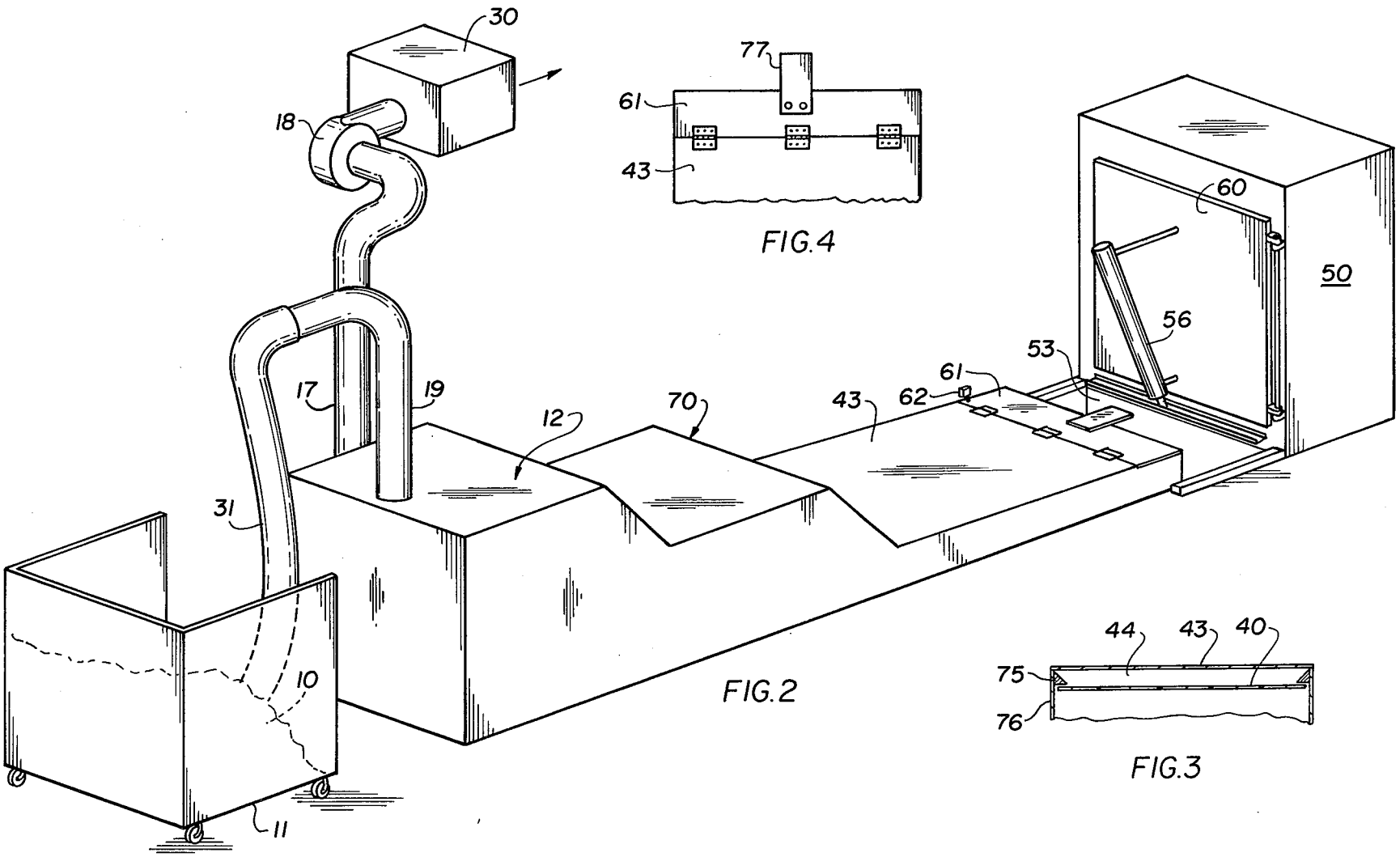
FIG. 2 is a perspective view of the external appearance of the system of the invention.
FIG. 3 is a cross sectional view of the system of FIG. 1, taken along the lines 3—3.
FIG. 4 is a top view of a modification of the packer actuating plate of the invention.
Figure 7:
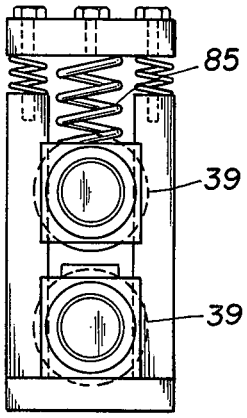
FIG. 7 is a side view showing the spring loading of a pair of rolls employed in Applicant's apparatus.
Figure 8A:
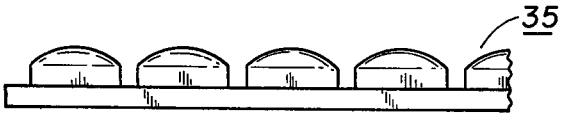
FIG. 8A is a front elevation view of a portion of the slat belt employed in Applicant's apparatus.
Figure 8C:
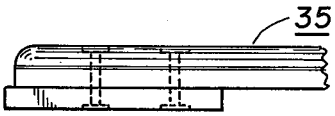
FIG. 8C is a side elevation view of said belt portion.
Figure 8B:
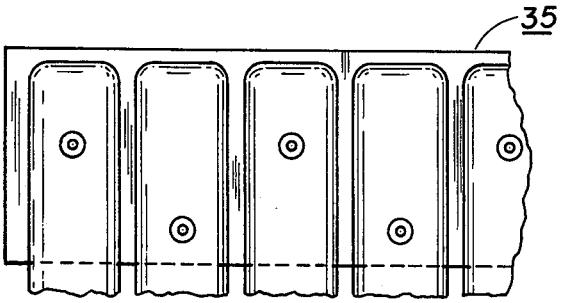
FIG. 8B is a top plan view of this slat belt portion.

In the first precompression stage, including the slat belt 35 and the rollers 36 and 37, no modification of the conventional equipment has been found necessary with respect to the expansion of the blanket at the sides thereof. In the chamber 44, however, it has been found necessary to partially confine the sides of the chamber 44, to inhibit undesirable lateral spreading of the blanket from the belt. Thus, as illustrated in FIG. 3, the sides of the chamber 44 may be formed by triangular inserts 75 mounted to the fixed side rails 76 which support the cover 43. The triangular inserts 75 extend longitudinally of the upper course of the belt 40, and are closely spaced therefrom, whereby the inserts 75 inhibit passage of the blanket over the lateral edges of the belt.

In the modification of the tripping plate 61 as illustrated in FIG. 4, a finger 77 has been affixed, for example by welding or bolting, to extend lengthwise of the system from the plate. The finger 77, which in the preferred example of the invention had a length of about 12 inches, enabled the blanket to more readily trip the switch 62, to initiate a packing operation.

In a preferred mode of operation of the invention, the switch 62 initiates an operating cycle of the packer, whereby the packer is automatically controlled to extend its foot 58 into the bale press five times sequentially, at a cycle speed of about one second. Such cycling of the packer occurs as long as the switch 62 has been actuated in response to the presence of sufficient material at the outlet of the chamber 44.

FIG. 5 schematically illustrates one embodiment of the packer system employed in FIG. 1. In this arrangement, the piston rod of double acting cylinder 57 is connected to the packer foot 58. Guide means, such as rods 83, are also connected to the packer foot, in order to direct the movement of the packer foot. Microswitches 78 may be provided, for example, cooperatively positioned with respect to stops or cams on the guide means, to be actuated at the desired highest and lowest positions of the packer foot. If desired, these positions may be adjustable, in accordance with conventional practice. The switches 78 are connected to a conventional hydraulic or pneumatic control system, for control of the double acting cylinder 57. In one technique for obtaining the desired cyclic movement of the packer foot, for example, the microswitch 62 may be coupled to set a conventional counter, for example, to a count of five, and conventional circuitry may be employed responsive to the existence of any count in the counter for actuating the pneumatic or hydraulic control of the cylinder 57. In this instance, one of the limit switches 78 may also be employed to effect the countdown of the counter, with both of the microswitches 78 being responsive (selectively) for reversing the movement of the packer foot. Thus, the desired control for the packer foot may be effected by simple means. It will of course be apparent that any other control system for effecting this purpose, in a conventional manner, may also be employed.

The control of the bale press may also be automatic, although this is not absolutely necessary. For example, an operator may manually operate the bale press to close the door 54 and form a portion of a bale following the unloading of each truck, and to complete the formation of the bale after the pressing of the contents of, for example, five trucks.

In the modification of the invention, as illustrated in FIG. 6, an automatic loader 80 may alternatively be connected to the end of the duct 31. In this arrangement, the operator need only move a truck 11 into the automatic loader 80, so that handling of the duct 31 is no longer necessary. The automatic loader 80, which is only schematically illustrated in FIG. 6, may be comprised of a vertically oriented belt 81 having vanes thereon, which is driven to direct the material 10 into the end 82 of the duct affixed thereto, as the truck 11 is moved manually or automatically with respect to the automatic loader.

With the bale press feeder of the above example of the invention, tests have shown that the amount of dust in the 4 to 15 micron range has been adequately reduced, so that workers may safely perform their functions on a full time basis in the bale press facilities.

While the invention has been disclosed with reference to a limited number of embodiments, it will be apparent that variations and modifications may be made therein, and it is intended in the following claims to cover each such variation and modification as falls within the true spirit and scope of the invention.

What is claimed is:

1. A feeder for feeding loose material to a bale press, comprising a condenser, means feeding said loose material to said condenser, prepacking means at the output of said condenser for increasing the density of the output of said condenser, means directing the output of said prepacking means to said bale press, packing ram means having a foot positioned to urge material into said bale press, and means responsive to the presence of materials to be baled at said directing means for operating said packing ram means.

2. The feeder of claim 1 wherein said prepacking means comprises a plurality of sequentially arranged rolling means having successively decreasing clearances.

3. The feeder of claim 1 wherein said prepacking means comprises a belt, and a plurality of rolls spaced from said belt at decreasing distances away from said condenser.

4. The feeder of claim 3 wherein said belt comprises a slat belt.

5. The feeder of claim 4 comprising at least two of said rolls spaced from said slat belt at decreasing distances away from said condenser, and means for rotating said rolls to have peripheral speeds greater than the speed of said slat belt, with the roll toward said condenser having the greater peripheral speed of said two aforementioned rolls.

6. The feeder of claim 5 further comprising a pair of additional rolls positioned downstream of said slat belt for receiving a blanket of material therefrom, said additional rolls being spring loaded toward one another and further comprising means for rotating said further rolls with peripheral speeds equal to the peripheral speed of said slat belt.

7. The feeder of claim 4 wherein said condenser comprises a perforated roll, a chute positioned to direct material from said perforated roll to said slat belt, and doff roll means positioned to direct a blanket of material from said perforated roll to said slat belt.

8. The feeder of claim 3 wherein said prepacking means further comprises a second belt, means directing said material from said first mentioned belt to said second belt, and a lid over said second belt and being spaced therefrom at a decreasing distance away from said condenser, for further pressing material thereon.

9. The feeder of claim 1 wherein said prepacking means comprises a first prepacking assembly including a plurality of roll means having decreasing clearance away from said condenser, and further comprising a second prepacking assembly for receiving material from said first prepacking assembly and comprising a conveying belt, and a chamber of decreasing height above said conveying belt for further compressing material.

10. The feeder of claim 9 further comprising a hinged lid at the downstream end of said chamber and positioned to be pivoted by material thereunder, said means responsive to the presence of said material to be baled comprising switch means coupled to said lid.

11. The feeder of claim 10 further comprising cross ribs on said conveying belt for feeding said material to said chamber.

12. The feeder of claim 9 wherein said bale press has a loading door having an open inclined position under the downstream end of said conveying belt, for receiving material and directing it to said bale press, and said packing ram means is fixedly mounted above said loading door, said foot being movable downwardly through said loading door into said bale press.

13. The feeder of claim 12 further comprising a plate hinged to the downstream end of said chamber above said belt, and a finger extending from said plate over said loading door, whereby prepacked material may force said finger upwardly to rotate said plate, and wherein said means responsive to the presence of said material comprises switch means cooperatively coupled to sense the rotation of said plate.

14. The feeder of claim 1 for receiving loose fibers from a bin, further comprising automatic loading means mountable on said bin for directing said loose fibers to said condenser.

15. A process for baling fibrous materials while minimizing the discharge of dust into the atmosphere, comprising sucking said fibrous materials into a condenser while filtering the air output of the condenser, to produce a fluffy blanket of said fibrous materials, mechanically continually precompressing said fluffy blanket by passing it sequentially through packing roll means of decreasing density, directing said precompressed blanket continually to a bale press, having a loading door periodically ramming said blanket into said bale press in response to the presence of said blanket at the loading door of said bale press, and then closing the door of said bale press and forming a bale of said material therein.

16. The process of claim 15 wherein said step of mechanically continually precompressing comprises feeding said fluffy blanket of a slat conveyor under a first driven roll having a peripheral speed greater than the peripheral speed of said slat conveyor, then passing said blanket under a second driven roll driven at a peripheral speed greater than the peripheral speed of said slat conveyor but less than the peripheral speed of said first roll, the clearance between said second roll and said conveyor being less than the clearance between said first roll and said conveyor, and thence feeding said blanket between a pair of said conveyor, and thence feeding said blanket between a pair of spring loaded rolls having peripheral speeds substantially equal to the peripheral speed of said slat conveyor.

17. The process of claim 15, wherein said ramming step comprises utilizing a packing ram having a foot to urge said blanket into said bale press.

* * * * *

UNITED STATES PATENT OFFICE
CERTIFICATE OF CORRECTION

Patent No. 4,075,942 Dated February 28, 1978

Inventor(s) Joe Johnson, Jr.

It is certified that error appears in the above-identified patent and that said Letters Patent are hereby corrected as shown below:

Column 1, line 53: "an" should be --and--.

Column 3, line 6: "water" should be --waste--.

line 39: Delete "and".

Column 10, line 32: "of" should be --on--.

lines 40-41: Delete "and thence feeding said blanket between a pair of said conveyor,".

Signed and Sealed this

*Fifth* Day of *September 1978*

[SEAL]

*Attest:*

RUTH C. MASON
*Attesting Officer*

DONALD W. BANNER
*Commissioner of Patents and Trademarks*